US008585354B1

(12) United States Patent
Liang

(10) Patent No.: US 8,585,354 B1
(45) Date of Patent: Nov. 19, 2013

(54) TURBINE RING SEGMENT WITH RIFFLE SEAL

(71) Applicant: George Liang, Palm City, FL (US)

(72) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 0 days.

(21) Appl. No.: 13/887,983

(22) Filed: May 6, 2013

Related U.S. Application Data

(63) Continuation of application No. 12/689,284, filed on Jan. 19, 2010, now abandoned.

(51) Int. Cl.
*F01D 25/14* (2006.01)

(52) U.S. Cl.
USPC ..... 415/135; 415/139; 415/173.1; 415/173.3

(58) Field of Classification Search
USPC ..... 415/134, 135, 139, 170.1, 173.1, 230, 415/173.3; 277/643–644
See application file for complete search history.

(56) References Cited

U.S. PATENT DOCUMENTS

| | | | | |
|---|---|---|---|---|
| 5,088,888 | A * | 2/1992 | Bobo | 415/170.1 |
| 5,374,161 | A * | 12/1994 | Kelch et al. | 415/139 |
| 5,975,844 | A * | 11/1999 | Milazar et al. | 415/138 |
| 6,893,215 | B2 * | 5/2005 | Kuwabara et al. | 415/139 |

* cited by examiner

*Primary Examiner* — Edward Look
*Assistant Examiner* — William Grigos
(74) *Attorney, Agent, or Firm* — John Ryznic

(57) ABSTRACT

A blade outer air seal with ring segments forming a mate face gap in which a riffle seal is placed to seal the axial gap. The riffle seal includes a horizontal plate and a vertical plate extending from a bottom surface of the horizontal plate and occupies the axial gap space. The bottom end of the vertical extending plate is angled in a direction of rotation of rotor blades and includes ribs that form open slots in the riffle seal. The ring segments include metering holes that discharge cooling air into the slots to discharge film cooling air onto the hot gas surface of the BOAS and cool the ring segments.

9 Claims, 3 Drawing Sheets

View A-A
Prior Art

View A-A

TURBINE RING SEGMENT WITH RIFFLE SEAL

CROSS-REFERENCE TO RELATED APPLICATIONS

This application is a CONTINUATION of U.S. patent application Ser. No. 12/689,284 filed on Jan. 19, 2010.

GOVERNMENT LICENSE RIGHTS

None.

BACKGROUND OF THE INVENTION

1. Field of the Invention

The present invention relates generally to gas turbine engine, and more specifically for a seal between adjacent segments of a blade outer air seal.

2. Description of the Related Art Including Information Disclosed Under 37 CFR 1.97 and 1.98

A gas turbine engine, such as an industrial gas turbine (IGT) engine, includes a turbine section with one or more rows or stages of stator vanes and rotor blades. The rotor blades include a blade tip that forms a blade outer air seal with a segmented outer shroud assembly. FIG. 1 shows a prior art turbine blade outer air seal (BOAS) inter-segment geometry arrangement for an IGT engine design. FIG. 2 shows a close-up view of the seal assembly between two adjacent BOAS segments. In this prior art BOAS design, there is no sealing arrangement to prevent hot gas ingression along the axial slot at the junction between two adjacent ring segments. As a result, hot gas flows in and out along the inter-segment gaps resulting in an over-temperature at the BOAS rails corresponding to the hot gas injection location.

BRIEF SUMMARY OF THE INVENTION

A blade outer air seal for a turbine rotor blade with a riffle seal having a horizontal section with teeth on the top surface that fits within two adjacent slots of the seal segments, and the riffle seal also having a vertical extending section that extends below from the horizontal section and has a bent end portion in which the vertical extending section fits within the space formed between adjacent seal segments and ends near to the hot gas flow path. the vertical section of the riffle seal includes open slots separated by ribs in which metering holes discharges cooling air and function as cooling flow diffusion slots to increase inter-segment cooling and minimize hot gas flow ingestion in and out along the inter-segment gap.

DETAILED DESCRIPTION OF THE INVENTION

Figure 1:
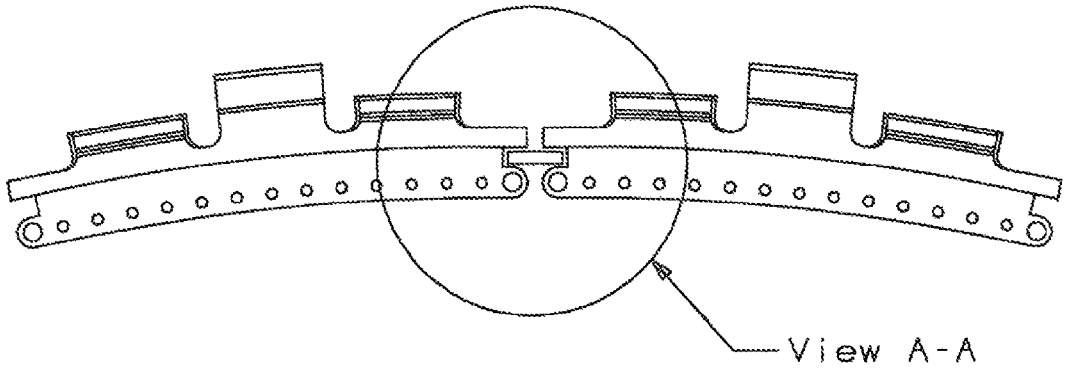
Fig 1 Prior Art
FIG. 1 shows a prior art blade outer air seal (BOAS) for an industrial gas turbine engine.
Figure 2:
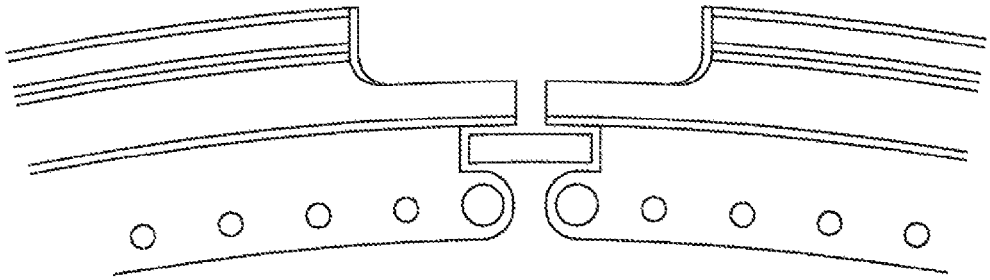
FIG. 2 shows a close-up view of the inter-segment seal and slots of the BOAS of FIG. 1.
Figure 3:
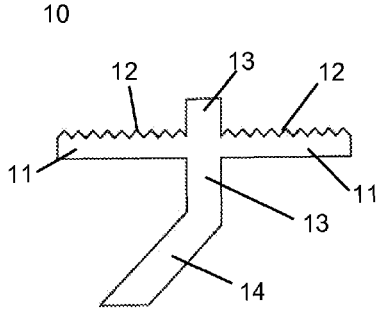
FIG. 3 shows a cross section view of a riffle seal of the present invention.

A blade outer air seal for a gas turbine engine, especially an industrial gas turbine engine, with a riffle seal secured within two slots of adjacent seal segments with the riffle seal extending into the gap formed between the adjacent seal segments. the riffle seal 10 of the present invention is shown in FIG. 3 and includes a horizontal plate 11 with teeth 12 that extend from an upper surface while smooth on the bottom surface, and a vertical plate 13 that extends from a bottom of the horizontal plate 11, in which the vertical plate 13 includes an end piece 14 that is angled at around 30 degrees from the vertical plate in a direction of a blade tip rotation. The vertical plate 13 also extends out from the top side of the horizontal plate 11. The riffle seal 10 fits within slots and a gap that is formed between adjacent segments of the BOAS.

Figure 4:
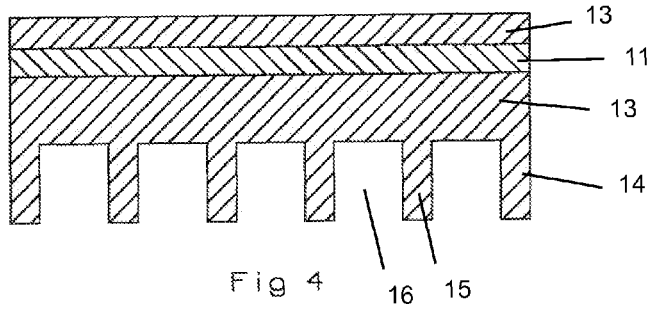
FIG. 4 shows a front view of the riffle seal of the present invention.

FIG. 4 shows a projection view of the riffle seal 10 of FIG. 3 with the horizontal plate 11 and the vertical plate 11 and the vertical plate 13 extending from both the top surface and the bottom surface of the horizontal plate 11. The angled ends 14 of the vertical plate 13 are shown with ribs 15 that form open slots 16 that extend a length of the angled end 14 of the vertical plate 13 from one end to the opposite end.

Figure 5:
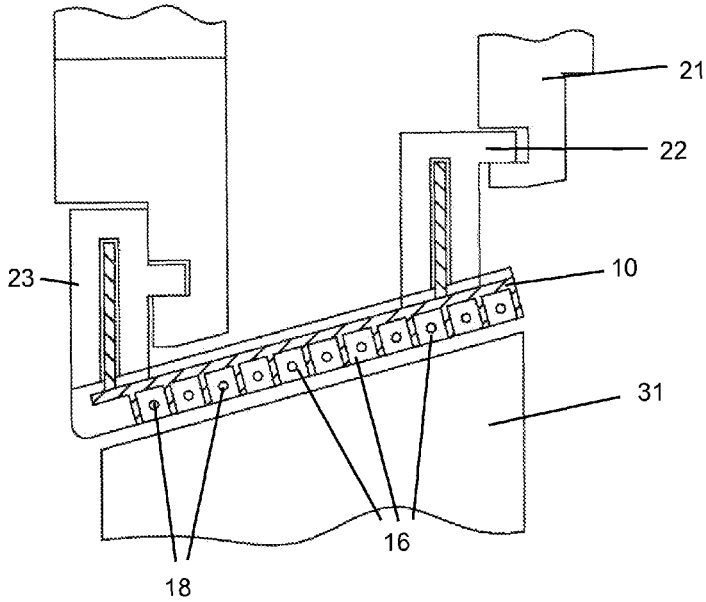
FIG. 5 shows a cross section side view of the riffle seal in a slot of a BOAS segment.

FIG. 5 shows a side view of a riffle seal 10 in place on one of the segments of the BOAS. The seal segment includes hooks 22 that extend from a top surface and engage with two isolation rings 21 of the turbine. The seal segment 23 includes a bottom surface that forms a gap with blade tips of the rotor blades 31. The seal segment 23 includes vertical slots and an angled slot in which seal members are placed to seal adjacent segments 23. The riffle seal 10 of the present invention is placed within the angled slot of the segments 23 and is shown in FIG. 5 with the open slots 16 on the bottom and the metering holes 18 opening into the slots 16.

Figure 6:
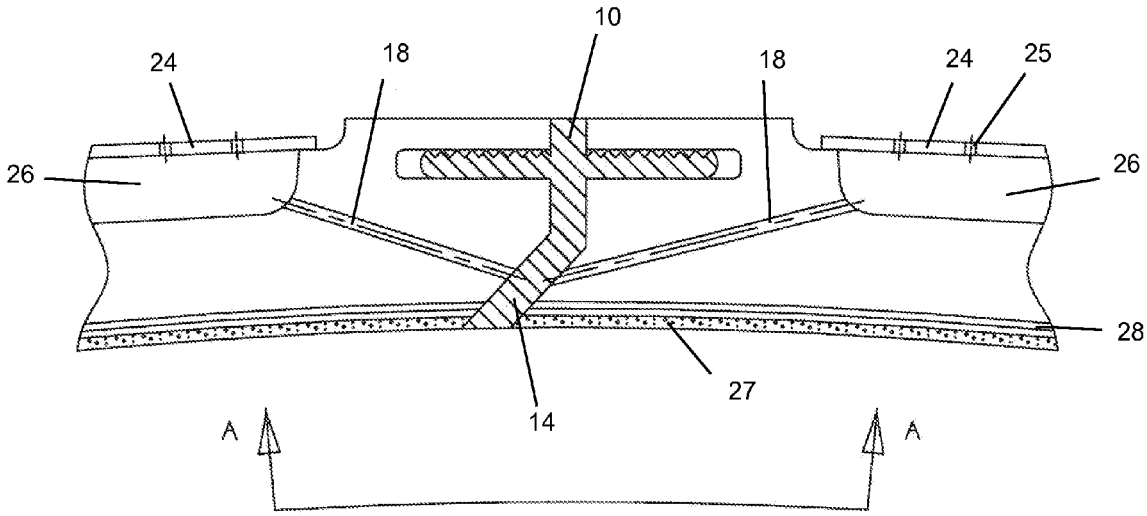
FIG. 6 shows a close-up view of the riffle seal of the present invention in the slots and gap formed between two adjacent seal segments.

FIG. 6 shows a close-up view of the riffle seal secured within the slots of adjacent segments from a side looking down the axial gap. The adjacent ends of the seal segments with the riffle seal 10 secured in slots is also referred to as the mate face of the ring segments. Each seal segment 23 includes a slot that opens onto the side such that an axial gap is formed between the adjacent seal segments 23. The riffle seal 10 of the present invention is secured within the two slots and the axial gap as seen in FIG. 6. Each seal segment 23 includes an impingement plate 24 with metering and impingement holes 25 that produce impingement cooling to an upper surface of the seal segments 23. Cooling air discharge holes 18 are connected to impingement cavities 26 and discharge the spent impingement cooling air into the slots 16 of the riffle seal 10. A TBC 27 is applied to a bond coat 28 that is applied to the underside or hot gas flow surface of the seal segments 23. As seen in FIG. 6, the riffle seal 10 extends up and flush with a top surface of the seal segments 23, and extends down the axial gap and flush with the TBC surface 27 on the underside of the seal segments 23.

Figure 7:
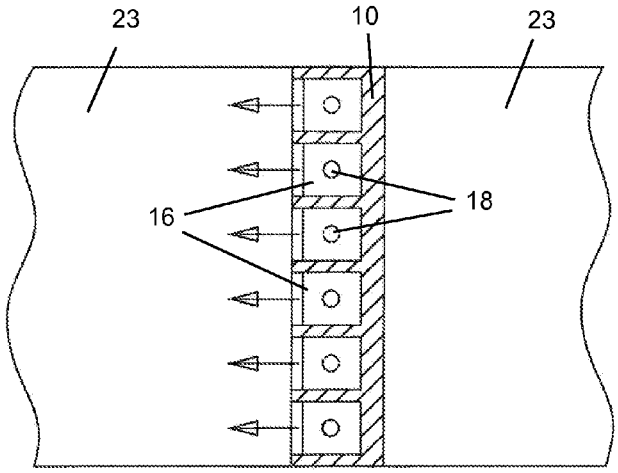
FIG. 7 shows a bottom view of the riffle seal in the gap with the open slots separated by ribs and the metering holes that discharge into the open slots.

FIG. 7 shows a view of the seal segments 23 with the riffle seal 10 from the bottom surface on which the TBC is applied. The metering holes 18 open into the slots 16 that are formed by the ribs 15 in the angled end 14 of the riffle seal 10. The angled end 14 of the riffle seal is angled in the direction of rotation of the rotor blade, which in FIG. 7 would be from right to left. The row of arrows represents the discharge of the spent impingement cooling air from the metering holes 18 and the slots 16.

In operation, cooling air impinges onto the backside of the blade outer air seal. The spent cooling air is then discharged along the BOAS peripheral holes for cooling of the rails. A portion of the cooling air is used for the inter-segment rail cooling and is bled through the metering holes 18 and then is diffused in the riffle seal slots 16 formed by the axial extending ribs 15 and the two ring segment mate faces. This cooling air is then discharged into the hot gas flow path to provide film cooling for the BOAS edge. The combination effects of metering and diffusion cooling and local film cooling provides for a very effective cooling arrangement for the BOAS inter-segments.

I claim the following:

1. A blade outer air seal for a turbine of a gas turbine engine comprising:

a first ring segment with a mate face having a seal slot;

a second ring segment with a mate face having a seal slot opposed to the first ring segment;

a row of metering holes formed within one of the two ring segments connecting to an impingement cavity on the inlets of the metering holes and opening onto the mate face surface on the discharge ends of the metering holes;

a riffle seal secured within the seal slots of both ring segments;

the riffle seal having a bottom section with a row of ribs that form a row of slots; and, the row of metering holes opening into the row of slots formed by the ribs of the riffle seal.

2. The blade outer air seal of claim 1, and further comprising:

the bottom section with the ribs that form the slots is angled in a direction of rotation of a rotor blade.

3. The blade outer air seal of claim 1, and further comprising:

a TBC applied to a hot gas side of the first and second rings segments; and, the ribs of the riffle seal are flush with the TBC surface.

4. The blade outer air seal of claim 1, and further comprising:

the first and second ring segments both include a row of metering holes that open into the slots formed by the ribs on the riffle seal.

5. The blade outer air seal of claim 1, and further comprising:

an axial gap formed by adjacent ring segments forms a vertical gap on a upper section of the axial gap and an angled gap on a lower section of the axial gap; and, the angled section of the axial gap is angled in a direction of rotation of a rotor blade.

6. A riffle seal for a blade outer air seal of a gas turbine engine, the riffle seal comprising:

a horizontal extending plate with a top surface having a plurality of teeth over most of the top surface;

a vertical extending plate that extends from a bottom surface of the horizontal plate at around a midpoint of the horizontal extending plate; and, the vertical extending plate includes a plurality or ribs that form a plurality of open slots.

7. The riffle seal of claim 6, and further comprising:

the vertical extending plate includes an angled end section in which the ribs are formed; and, the angled end section is angled in a direction of rotation of a rotor blade.

8. The riffle seal of claim 7, and further comprising:

the angled end section is angled at around 30 degrees.

9. The riffle seal of claim 6, and further comprising:

the vertical extending plate also extends out from the top surface of the horizontal extending plate.

* * * * *